US006407352B1

(12) United States Patent
Aluise, Sr.

(10) Patent No.: US 6,407,352 B1
(45) Date of Patent: Jun. 18, 2002

(54) DISTRIBUTOR CAP ADAPTOR FOR AFTER MARKET DISTRIBUTORS

(75) Inventor: Joseph R. Aluise, Sr., Beltsville, MD (US)

(73) Assignee: Metro Motorsports, Inc., Beltsville, MD (US)

( * ) Notice: Subject to any disclaimer, the term of this patent is extended or adjusted under 35 U.S.C. 154(b) by 0 days.

(21) Appl. No.: 09/610,900

(22) Filed: Jul. 6, 2000

(51) Int. Cl.[7] ..... F02P 7/00; H01H 19/02

(52) U.S. Cl. ..... 200/19.39; 123/146.5 A; 200/19.32

(58) Field of Search ..... 123/146.5 A; 200/19.01–19.4

(56) References Cited

U.S. PATENT DOCUMENTS

| | | | | |
|---|---|---|---|---|
| 1,177,923 A | | 4/1916 | Brown | 200/19.32 |
| 2,457,916 A | | 1/1949 | Newton | 361/269 |
| 3,399,657 A | | 9/1968 | Amblard | 123/146.5 A |
| 3,660,623 A | | 5/1972 | Bevacqua | 123/146.5 A |
| 3,906,917 A | | 9/1975 | Lorti | 123/146.5 A |
| 4,011,851 A | | 3/1977 | Beutler | 123/146.5 A |
| 4,046,123 A | * | 9/1977 | Jordan et al. | 200/19.01 X |
| 4,182,940 A | | 1/1980 | Scussel et al. | 200/19.39 |
| 4,342,292 A | | 8/1982 | House et al. | 123/146.5 A |
| 4,445,493 A | * | 5/1984 | Coletti | 200/19.4 X |
| 4,538,564 A | | 9/1985 | Ehrmann et al. | 123/406.5 |
| 4,632,077 A | | 12/1986 | Novak et al. | 123/146.5 A |
| 4,710,598 A | | 12/1987 | McAbee et al. | 200/19.03 |
| 5,701,875 A | | 12/1997 | Judd | 123/595 |

* cited by examiner

*Primary Examiner*—J. R. Scott
(74) *Attorney, Agent, or Firm*—Arent Fox Kintner Plotkin & Kahn, PLLC

(57) ABSTRACT

A distributor cap adaptor that secures an after market distributor cap adaptor to a distributor. The distributor distributes high voltages to spark plugs in an internal combustion engine. The after market distributor cap having a terminal distance diameter that is 15% greater than a conventional distributor cap. The connection of the after market distributor cap to a body of the distributor cap adaptor provides an improved insulation value that substantially eliminates ignition cross fire in the internal combustion engine.

20 Claims, 3 Drawing Sheets

DISTRIBUTOR CAP ADAPTOR FOR AFTER MARKET DISTRIBUTORS

BACKGROUND

1. Field of the Invention

This invention relates to a distributor cap adaptor used to secure an after market distributor cap to a computer controlled electronic distributor that distributes voltages to spark plugs in internal combustion engines.

2. Discussion of Related Art

Conventional computer controlled electronic distributors distribute high voltage to spark plugs in various conventional internal combustion engines. After market distributor caps are commercially available and used throughout the automotive after market industry. However, in high ignition load circumstances, a small conventional distributor cap can allow a high voltage spark to be directed to an incorrect distributor cap terminal, i.e., a wrong cylinder. Furthermore, even though a correct cylinder terminal is closer in distance, the correct cylinder terminal may have a higher load that requires more energy to fire the sparkplug than an adjacent terminal which is longer in distance but lower in load requirements. Accordingly, when the spark goes to the adjacent terminal, cross fire results, thereby severely damaging the conventional internal combustion engine.

SUMMARY OF THE INVENTION

An object of this invention is to overcome the above-discussed drawbacks of the conventional distributor cap.

Another object of this invention is to provide a distributor cap adaptor that can be fitted to the conventional computer controlled electronic distributor. The distributor cap adaptor of this invention permits an after market distributor cap having a larger diameter than the conventional distributor cap to be installed on a distributor to eliminate ignition cross fire. In particular, the distributor cap adaptor of this invention provides a larger terminal diameter distance than conventional distributor caps, which results in an increase in an insulating distance.

The increase in the insulating distance eliminates cross fire, thereby eliminating the severe damage to conventional internal combustion engines. Moreover, the distributor cap adaptor of this invention can be installed on conventional computer controlled electronic distributors by an automobile mechanic with minimal effort.

BRIEF DESCRIPTION OF THE DRAWINGS

Other objects and features of this invention will be better understood from the following description, with reference to the accompanying drawings, wherein.

DETAILED DESCRIPTION OF PREFERRED EMBODIMENT

Figure 1:
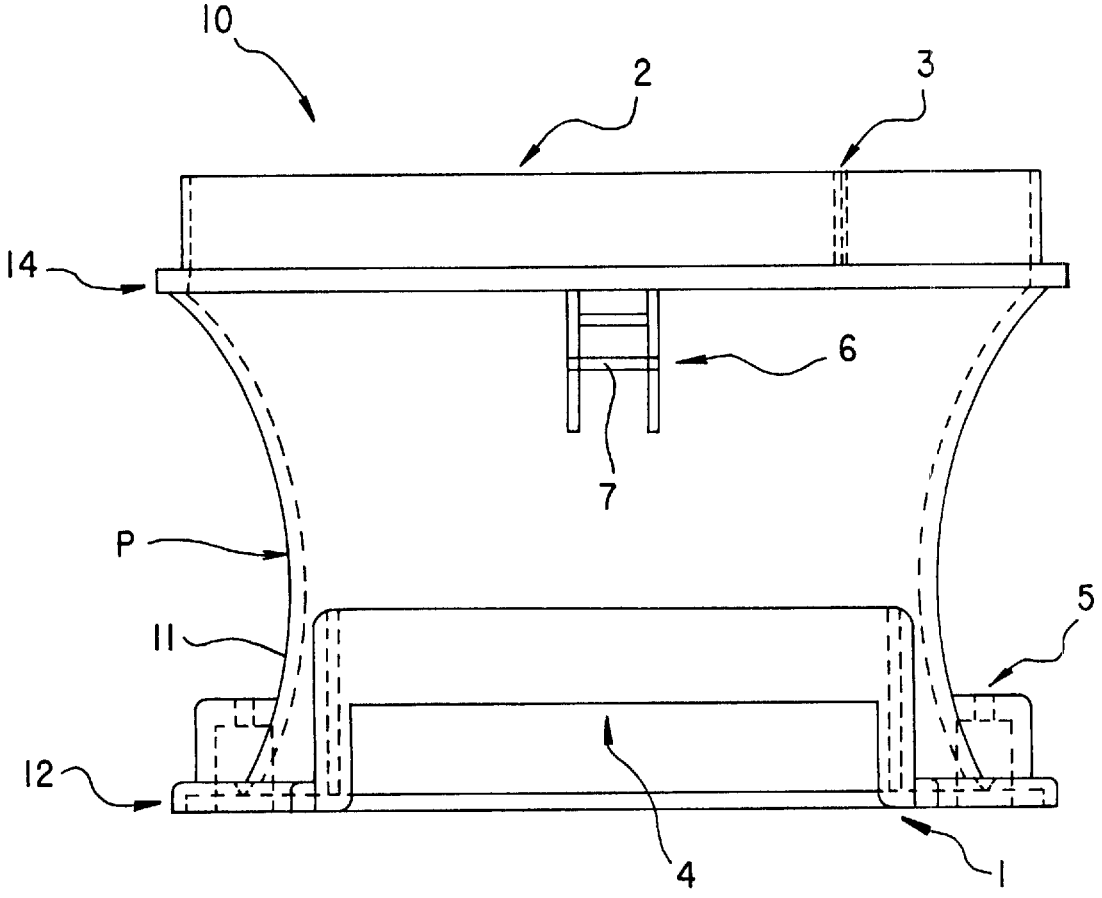
FIG. 1 is a side view of the distributor cap adaptor according to this invention.

FIG. 1 is a side view of the distributor cap adaptor of this application. The distributor cap adaptor 10 is formed from a thermal plastic having a high dielectric strength. The plastic is injection molded to the shape illustrated to help elevate an ignition cross fire threshold of the internal combustion engine. Ideally, the plastic should also be resistant to harsh elements commonly found in engine compartments of internal combustion engines, such as, for example, oil, fuel, internal ozone formation, and the like.

The distributor cap adaptor 10 has a precision molded base 12 that is designed to have a relatively tight and secure fit with a distributor cap (not shown) to which the distributor cap adaptor 10 is affixed. A body 11 of the distributor cap adaptor 10 is substantially cylindrical with an outer diameter that decreases relative to a diameter of the base 12. In particular, the outer diameter of the body 11 decreases in a radial direction toward a central axis of the distributor cap adaptor 10 to a minimum outer diameter point P approximately midway relative to a vertical height of the distributor cap adaptor 10. The outer diameter of the body 11 increases from the minimum outer diameter point P to a top 14 of the distributor cap adaptor 10.

The base 12 of the distributor cap adaptor 10 has an adaptor register 1 to affix the distributor cap adaptor 10 to a conventional computer controlled electronic distributor. In other words, the distributor cap adaptor 10 is affixed to the conventional computer controlled electronic distributor at the adaptor register 1. The distributor cap adaptor 10 can be affixed by any known manner, such as, for example, screws, clips, bolts, and other well known fasteners.

For example, FIG. 1 illustrates a situation where the distributor cap adaptor 10 is configured to have a plurality of through holes 5. The through holes 5 are designed to receive fasteners, i.e., screws or bolts, to affix the distributor cap adaptor 10 to the distributor. It should be noted that the conventional computer controlled electronic distributor typically has an outer diameter that is smaller than the diameter of the base 12 having the adapter register 1. Therefore, the distributor cap adaptor 10 of this invention is affixed, i.e., screwed or bolted, to the conventional computer controlled electronic distributor to permit the use of a larger after market distributor cap.

Positioned above the adapter register 1 of the base 12 is a distributor index and computer wiring conduit 4. The wiring conduit 4 is connected to an ignition wire (not shown) by a conventional form of a connector (not shown). The ignition wire is typically controlled by the ignition switch on an instrument panel of a vehicle.

Positioned above the top 14 of the distributor cap adaptor 10 is a distributor cap register 2. The distributor cap register 2 has an outer diameter that is larger than an outer diameter of the after market distributor cap. The distributor cap register 2 also has a distributor cap index tang 3 that aligns the after market distributor cap for connection to the distributor cap adaptor 10.

Furthermore, below the top 14 of the distributor cap adaptor 10 on the exterior of the body 11 are at least two spring clip catches 6, 6. Each spring clip catch 6 has a roll pin hole that receives a roll pin 7. The roll pin 7 can be inserted through the roll pin hole and used to securely hold down the spring clips (not shown) in a conventional manner. For example, the roll pin holes can be configured to receive a 0.0625 inch diameter roll pin 7. Accordingly, the spring clips of the after market distributor cap can be snap attached to the roll pins 7, 7 of the spring clip catches 6, 6 to hold the after market distributor cap to the distributor cap adaptor 10.

Moreover, the after market distributor cap, which is larger than conventional distributor caps, can be aligned by the distributor cap index tang 3 and connected to the distributor cap adaptor 10 at the adaptor register 2. Meanwhile, the snap attachment of the spring clips of the distributor cap to the spring clip catches 6, 6 simultaneously holds the distributor cap in place on the distributor cap adaptor 10. Thus, the larger after market distributor cap can be used with the conventional computer controlled electronic distributor.

Figure 2:
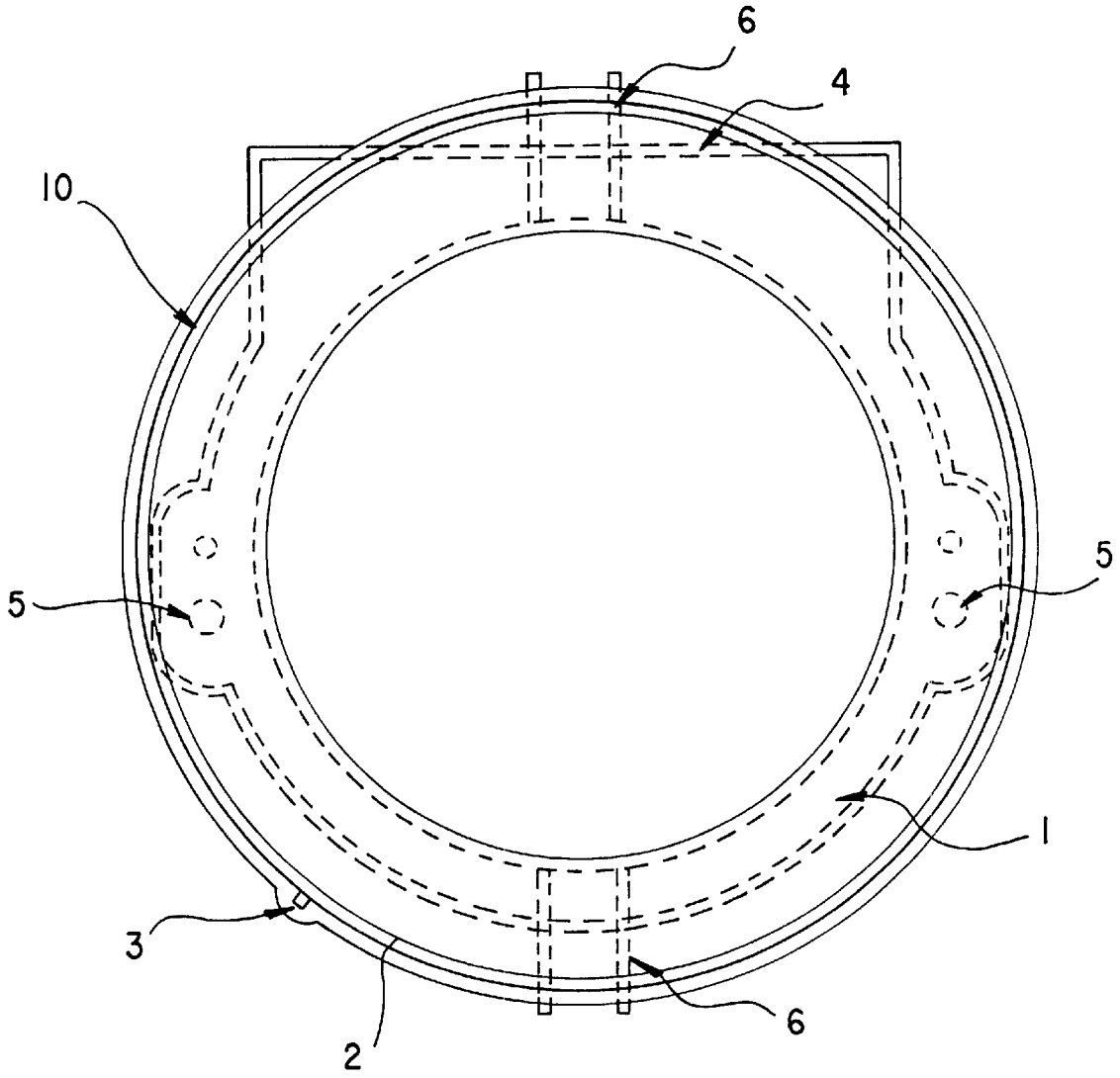
FIG. 2 is a bottom view of the distributor cap adaptor showing FIG. 1.

FIG. 2 is a top view of the distributor cap adaptor 10 of this invention. As illustrated, the distributor cap adaptor 10 can have at least two sets of opposing through holes 5, 5 and spring clip catches 6, 6. The through holes 5, 5 are used to secure the distributor cap adaptor 10 to the conventional computer controlled electronic distributor while the spring clip catches 6, 6 secure the distributor to the adaptor 10.

Figure 3:
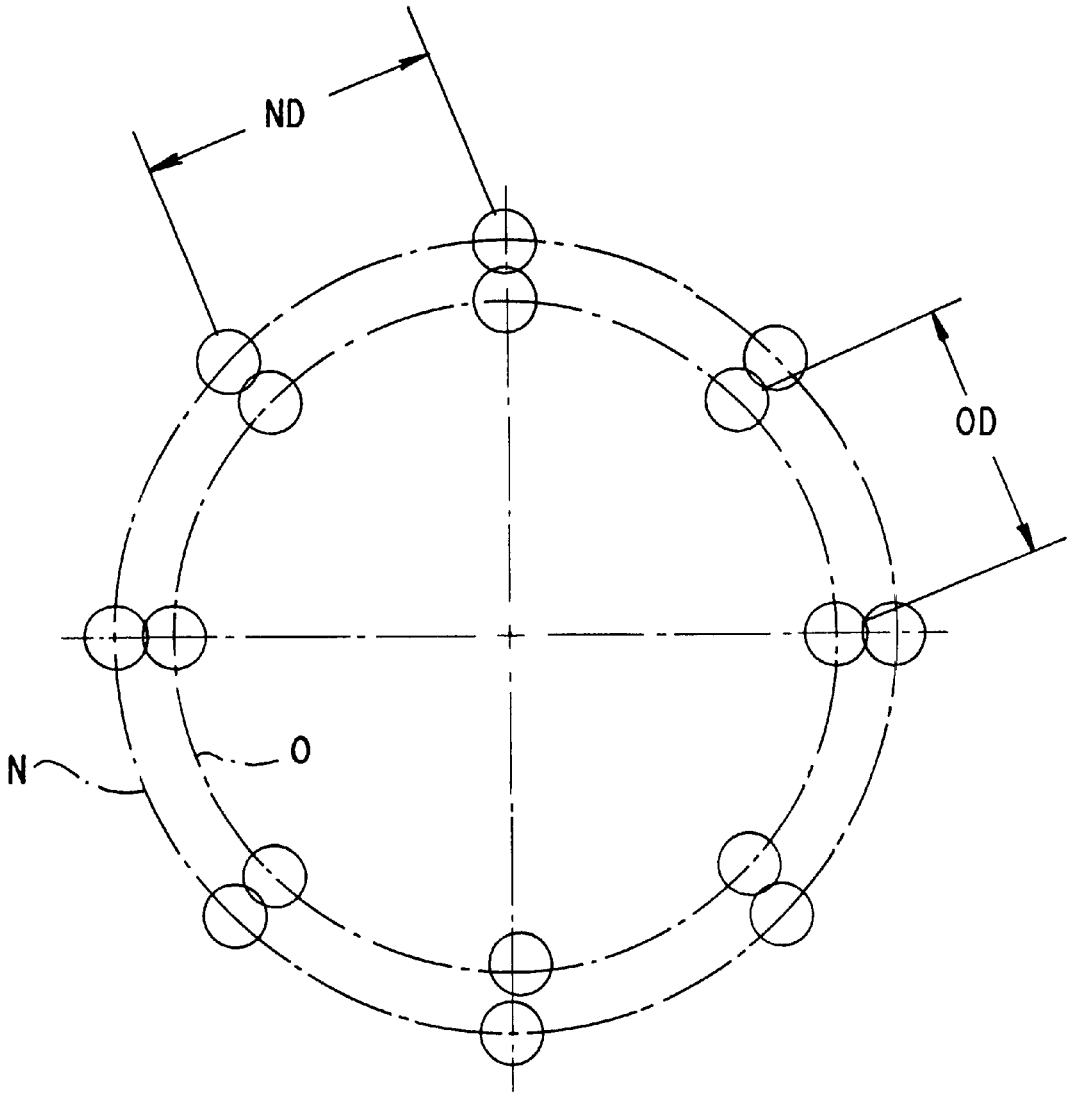
FIG. 3 is a plan view of the conventional distributor cap with an after market distributor cap overlaid thereon to illustrate the difference in spacing between respective terminals.

FIG. 3 is a top view of a conventional distributor cap O with the after market distributor cap N overlaid to show the difference in terminal spacing. The conventional distributor cap O has a terminal spacing OD that is smaller than a terminal spacing ND for the after market distributor cap N. For example, the terminal spacing of the conventional distributor cap O can be approximately 1.272 inches while the terminal spacing ND of the after market distributor cap N can be approximately 1.492 inches.

Additionally, the conventional distributor cap O can have a terminal distance diameter of approximately 3.325 inches. Furthermore, the after market distributor cap N can have a terminal distance diameter of approximately 3.925 inches, which represents an approximately 15% increase in the insulating distance. Consequently, the increased insulating distance provided by the after market distributor cap N eliminates cross fire and the subsequent damage to the engine. In other words, the distributor cap adaptor 10 of this invention results in an improved insulation value associated with the cause of ignition cross fire when used with an after market distributor cap having an insulating distance that is approximately 15% greater that conventional distributor caps.

Additionally, many modifications may be made to adapt the teachings of the distributor cap adaptor of this invention to particular situations or materials without departing from the scope thereof. Therefore, it is contended that this invention not be limited to the particular embodiment disclosed herein, but includes all embodiments within the spirit and scope of the disclosure.

I claim:

1. A distributor cap adaptor to secure an after market distributor cap to a distributor that distributes voltages to spark plugs in an internal combustion engine, the after market distributor cap having an outer diameter and a terminal distance diameter, the terminal distance diameter is approximately 15% greater than a conventional distributor cap, comprising:

a substantially cylindrical body providing a base and a top, the body having an outer diameter that decreases relative to an outer diameter of the base in a radial direction toward a central axis to a minimum outer diameter point and increases from the minimum outer diameter point to the top, the body being affixed to the distributor at the base; and a distributor cap register disposed above the top of the body, an outer diameter of the distributor cap adaptor being larger than the outer diameter of the after market distributor cap to receive and connect the after market distributor cap to the body, wherein the connection of the after market distributor cap to the body of the distributor cap adaptor results in an improved insulation value that substantially eliminates the cause of ignition cross fire in the internal combustion engine.

2. The adaptor according to claim 1, wherein the minimum outer diameter point is located approximately midway between the base and top of the adaptor relative to a vertical height of the adaptor.

3. The adaptor according to claim 1, wherein the distributor cap register further comprises a distributor cap index tang to align the after market distributor cap being connected to the adaptor.

4. The adaptor according to claim 1, further comprising at least two spring clip catches disposed on an exterior and below the top of the body of the adaptor.

5. The adaptor according to claim 4, wherein each of the at least two spring catches has a roll pin hole configured to receive a roll pin that securely holds spring clips of the after market distributor cap.

6. The adaptor according to claim 5, wherein the roll pin has a 0.0625 inch diameter.

7. The adaptor according to claim 1, wherein the base further comprises an adaptor register that affixes the adaptor to the distributor, the adaptor register having an outer diameter that is larger than a distributor outer diameter.

8. The adaptor according to claim 1, further comprising at least two through holes designed to receive fasteners there through to affix the adaptor to the distributor.

9. The adaptor according to claim 8, wherein the fasteners are selected from a group including screws and bolts.

10. The adaptor according to claim 1, further comprising a distributor index and computer wiring conduit disposed above the base of the body, the wiring conduit connecting the adaptor to an ignition wire.

11. The adaptor according to claim 1, wherein the body of the adaptor comprises an injection molded plastic.

12. The adaptor according to claim 11, wherein the plastic comprises a thermal plastic having a high dielectric strength that is resistant to harsh engine compartment elements of the internal combustion engine.

13. The adaptor according to claim 12, wherein the harsh engine compartment elements comprise one of the group including oil, fuel, and internal ozone formation.

14. A distributor cap adaptor to secure an after market distributor cap to a distributor that distributes voltages to spark plugs in an internal combustion engine, the after market distributor cap having an outer diameter and a terminal distance diameter, the terminal distance diameter is approximately 15% greater than a conventional distributor cap, comprising:

a substantially cylindrical injection molded plastic body having a dielectric strength that is resistant to at least one of oil, fuel and internal ozone formation, the body providing a base and a top, the body having an outer diameter that decreases relative to an outer diameter of the base in a radial direction toward a central axis to a minimum outer diameter point and increases from the minimum outer diameter point to the top, the body being affixed to the distributor at the base; and a distributor cap register disposed above the top of the body, an outer diameter of the distributor cap adaptor being larger than the outer diameter of the after market distributor cap to receive and connect the after market distributor cap to the body, wherein the connection of the after market distributor cap to the body of the distributor cap adaptor results in an improved insulation value that substantially eliminates the cause of ignition cross fire in the internal combustion engine.

15. The adaptor according to claim 14, wherein the minimum outer diameter point is located approximately midway between the base and top of the adaptor relative to a vertical height of the adaptor.

16. The adaptor according to claim 14, wherein the distributor cap register further comprises a distributor cap index tang to align the after market distributor cap being connected to the adaptor.

17. The adaptor according to claim 14, further comprising at least two spring clip catches disposed on an exterior and below the top of the body of the adaptor, wherein each of the at least two spring catches has a roll pin hole configured to receive a roll pin that securely holds spring clips of the after market distributor cap.

18. The adaptor according to claim 14, wherein the base further comprises an adaptor register that affixes the adaptor to the distributor, the adaptor register having an outer diameter that is larger than a distributor outer diameter.

19. The adaptor according to claim 14, further comprising at least two through holes designed to receive fasteners there through to affix the adaptor to the distributor.

20. The adaptor according to claim 1, further comprising a distributor index and computer wiring conduit disposed above the base of the body, the wiring conduit connecting the adaptor to an ignition wire.

* * * * *